United States Patent [19]

Takagi

[11] Patent Number: 4,891,672

[45] Date of Patent: Jan. 2, 1990

[54] IMAGE FORMING APPARATUS WITH DEVELOPING DEVICE ACCOMMODATING APPARATUS

[75] Inventor: Masafumi Takagi, Kawasaki, Japan

[73] Assignee: Canon Kabushiki Kaisha, Tokyo, Japan

[21] Appl. No.: 166,003

[22] Filed: Mar. 9, 1988

[30] Foreign Application Priority Data

Mar. 10, 1987 [JP] Japan ..... 62-52925

[51] Int. Cl.[4] ..... G03G 15/01

[52] U.S. Cl. ..... 355/245; 355/326

[58] Field of Search ..... 355/4, 3 DD, 14 D, 3 R, 355/14 R, 245, 326–328

[56] References Cited

U.S. PATENT DOCUMENTS 4,542,979 9/1985 Percic ..... 355/4

FOREIGN PATENT DOCUMENTS 57-204566 12/1982 Japan ..... 355/327
57-204567 12/1982 Japan ..... 355/245
60-67970 4/1985 Japan .
61-63866 4/1986 Japan .

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

An image forming apparatus has a main assembly including an image bearing member and a device for forming a latent image on the image bearing member and an; accommodating device for accommodating a plurality of developing devices; the main assembly further including first developing device moving device for moving the developing devices; the accommodating device including second developing device moving device for moving the developing devices to a position at which the developing devices can be supplied into the main assembly and third developing device moving device for moving the developing devices from the supplying position into the main assembly; device for selecting a developing device for developing a latent image formed by the image forming device; device for starting image forming operation by the image forming device; and control device for controlling the first and second moving device, the control device operating the second moving device in response to a signal from the selecting device to place the developing device selected by the selecting device to the supply position and operating the third moving device in response to a signal from the image formation starting device to move the selected developing device into the main assembly.

9 Claims, 7 Drawing Sheets

IMAGE FORMING APPARATUS WITH DEVELOPING DEVICE ACCOMMODATING APPARATUS

FIELD OF THE INVENTION AND RELATED ART

The present invention relates to an image forming apparatus for accommodating plural developing device for an image forming apparatus such as copying machine, recording machine and printer, more particularly to such apparatuses wherein the developing device is detachably mountable into the image forming apparatus.

Conventionally, a developing apparatus is set in place in an image forming apparatus such as a copying machine by an expert service operator, and thereafter, the user operator does not take the developing device out of the copying machine. Therefore, it has been dominant that a service man manually inserts the developing device into the assembly to a position, for example, a position where the developing device is near a photosensitive member but is not contacted to the photosensitive member, and then, a manual lever is operated to urge the developing device to the photosensitive drum to correctly position it with respect to the photosensitive member. This type is disclosed in U.S. Pat. Nos. 4,373,468 and 4,583,832, for example.

Recently, however, a new type of image forming apparatus has become widely used wherein the developing device is replaceable with another developing device containing a different color toner such as red and blue in addition to black so as to permit image formation with a different color. With this trend, it is more frequent that the user operator himself mounts the developing device into the apparatus or demounts it therefrom. This type is disclosed, for example, in U.S. Pat. Nos. 4,470,689, 4,500,195 and 4,575,221 wherein a process unit containing a photosensitive member and developing means is replaced; and U.S. Ser. No. 802,537 filed on Nov. 27, 1985 and assigned to the assignee of this application, wherein the apparatus contains two developing devices selectively usable, and wherein one of the developing devices is made exchangeable.

There is another proposal, as disclosed U.S. Ser. No. 844,718 filed on Mar. 27, 1986, now U.S. Pat. No. 4,801,966, issued Jan. 31, 1989 and assigned to the assignee of the present application, wherein two developing devices are made selectively operable. Another proposal has been made in U.S. Pat. Nos. 4,615,612 and 4,622,916 wherein the apparatus has a turret type developer accommodating means.

However, since all of the above described systems involve manual exchange or replacement of the developing device, it requires cumbersome work and involves the possibility that the developing device will hit the apparatus or the like, thus imparting unnecessary shock or vibration to the developing device.

On the other hand, considering the developing operation, the size of the developer particles is becoming smaller in order to improve the image quality, more particularly the sharpness, with the result that the fluidability of the developer is becoming higher when the developer is mixed with air. Therefore, it is required that the developing device be handled with great care, since otherwise the developer will become distributed in the container non-uniformly, or the developer will be scattered out.

Generally, the non-uniform distribution of the developer in the container is solved by stirring the developer, and in consideration of variations in the manner of handling by different users; the stirring period is made relatively long to cover such wide variations. Therefore, the time required until a first copy is obtained is long after the developing device is exchanged, or after developer is supplied in the type of the device wherein the developing device is demounted from the apparatus for supplying the developer. Where the developing device is limited by a stopper when the developing device is mounted into the apparatus, the degree of resulting non-uniform distribution of the developer and the scattering vary depending on the speed at which the user abuts the developing device to the stopper.

More particularly, in the system wherein the mounting of the developing device is performed by the user, the mounting operation may include closing a drawer by the user, and therefore, the shock imparted to the developing device is different depending on the force applied by the user in mounting it. If strong force is applied, a strong shock is applied in the longitudinal direction of the developing device (in the system wherein the developing device is inserted through a front door of the apparatus in a direction of a generating line of a photosensitive drum contained therein), the developer in the container becomes non-uniformly distributed in the longitudinal direction. And, the developer having been urged to the rear side may blow out through a clearance around a cover of the developing device to scatter out. Particularly, when the developer is replenished, a toner bottle containing a supply of developer to be replenished is shaken so as to increase the fluidability of the developer in order for the developer therein to be completely removed from the developer bottom into the container of the developing device. This makes the developer easy to scatter.

When the developing device is exchanged, the developer contained in the developer container in the developing device usually has been kept stationary for a relatively long period of time, and therefore, the fluidability is not so high. However, if it becomes once non-uniformly distributed, it is required that the developer is positively and relatively strongly stirred by stirring means such as a stirring rod. Therefore, the time period for pre-rotation of the photosensitive member to prepare the apparatus for image forming operation, has to be longer. This also results in a longer time period to the output of first copy from the start of the copying apparatus.

From the users standpoint, various positioning means or other means have to be operated when the developing device is demounted or mounted, and therefore, the mounting or dismounting is cumbersome.

A proposed solution to the above problems is disclosed in U.S. patent application Ser. No. 071,316 filed on July 9, 1987. The proposal contains, as a feature, a passage in the image forming apparatus to allow the developing device to be mounted into or demounted from the apparatus. Further proposals have been made in U.S. patent applications U.S. Ser. Nos. 111,761 filed Oct. 23, 1987 and 116,957 filed Nov. 5, 1987 which have been assigned to the assignee of this invention. These proposals are a further improvement in that a plurality of developing devices are accommodated and are set in place without requiring cumbersome manipulation by the user. The present invention is aimed at yet further improvement in the stabilization of the horizontal and/or vertical movement and the manual loading of the developing device.

Particularly, U.S. Ser. No. 116,957 discloses that the developing device setting operation starts after copying operation starts.

SUMMARY OF THE INVENTION

Accordingly, it is a principal object of the present invention to provide an image forming apparatus with developing device accommodating means wherein the time period required for the entire image forming operation can be reduced.

It is another object of the present invention to provide an image forming apparatus having a main assembly and a developing device accommodating means for accommodating plural developing devices in which the cooperation is controlled sequentially in good order.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
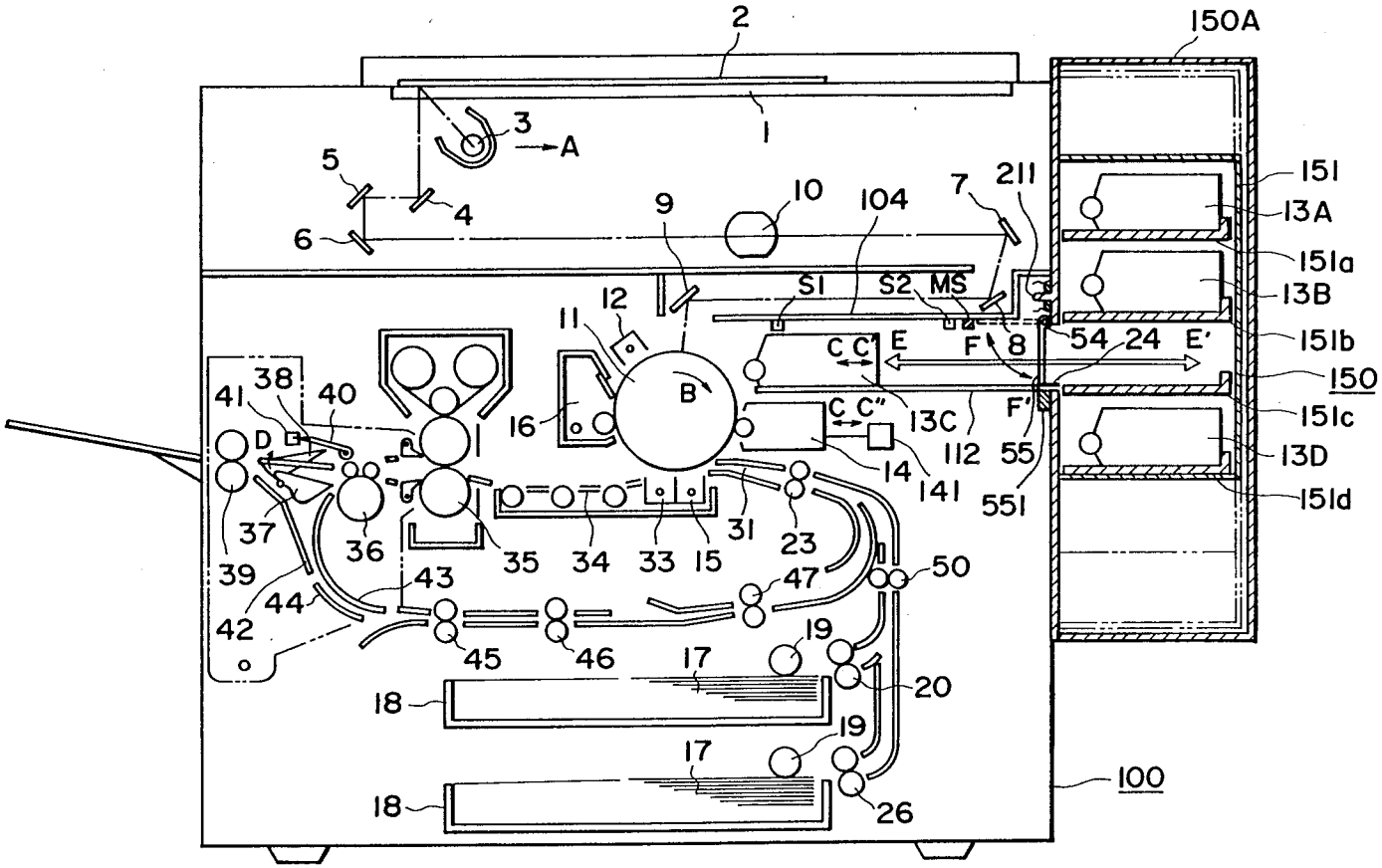
FIG. 1 is a sectional view of an image forming apparatus according to an embodiment of the present invention.

Referring to FIG. 1, there is shown an image forming apparatus, more particularly a copying machine in this example, used with an apparatus for accommodating plural developing devices according to an embodiment of the present invention. The exemplified image forming apparatus is capable of performing forming images on the opposite sides of a sheet in different colors and capable of forming superimposed images in different colors.

Before describing the developing device accommodating apparatus according to this embodiment, the image forming apparatus usable with the developing apparatus accommodating apparatus will be described.

In the image forming apparatus, an original 2 placed on an original supporting platen glass 1 is illuminated by a lamp 3, and the resulting image light is introduced onto a photosensitive drum (image bearing member) 11 by way of an optical system including a reflecting mirrors 4, 5, 6, 7, 8 and 9 and zoom lens 10. The lamp 3 and the mirror 4 and the mirrors 5 and 6 are moved at predetermined respective speeds in the direction indicated by an arrow A to scan the original 2. On the other hand, the photosensitive drum 11 is rotating in the direction indicated by an arrow B while being uniformly charged by a primary charger 12. When the light image is applied on the surface of the photosensitive drum 11 which has been thus electrically charged, an electrostatic latent image is formed in accordance with the original 2. Adjacent to the surface of the photosensitive drum 11, there are provided a chromatic color developing device 13C containing a chromatic color developer (green, for example) and a black developer 14 containing black developer. The developing devices 13C and 14 are movable in directions C and C′, respectively to access to the photosensitive drum 11 in accordance with selection of the color to develop the electrostatic latent image on the photosensitive drum 11 into a visualized image. In FIG. 1 the chromatic developing device (green developing device, for example) 13C is disposed away from its operative position, while the black developing device 14 is in its operative position close to the photosensitive drum 11, so that a black image can be formed on the photosensitive drum 11. The developed image is transferred onto a sheet of paper (recording medium) by a transfer charger 15. Thereafter, the surface of the photosensitive drum 11 is conveyed to the cleaning means which is a cleaning station 16 where the remaining toner is removed from the surface of the photosensitive drum 11, so that it is prepared for the next image forming operation. The sheet 17 is fed in the following manner. There are several types of supplying means for supplying the sheet 17 to an image forming station including a photosensitive drum 11. In a first type, the sheet 17 accommodated in an upper cassette 18 is fed to the roller couple 20 by a pickup roller 19. The roller couple 20 is effective, when two or more sheets 17 are fed out, to separate the topmost sheet 17 and supply it to the image forming station. The sheet 17 having passed through the roller couple 20 advances to registration rollers 23 by way of guiding plates, feeding roller couple 50 and additional guiding plates. In the second type, the sheet 17 accommodated in the lower cassette 18 is fed to a roller couple 26 by a pickup roller 19, in similar manner as described above. The registration rollers 23 once stops the sheet 17 and starts to rotate in timed relationship with the developed image formed on the photosensitive drum 11 to align the image with the sheet. After rotation of the start of the registration rollers 23 the sheet 17 is advanced to the surface of the photosensitive drum 11 by way of a top guide 31 and a bottom guide 32. The sheet 17 receives the image from the photosensitive drum 11 by the operation of a transfer charger 15. The sheet 17 is then separated from the surface of the photosensitive drum 11 by the separating charger 33 and is further advanced through the conveying passage 34 to an image fixing device 35 which contains a heating roller and a pressing roller. By the fixing device 35, the sheet 17 is heated and pressed so that the image on the sheet 17 is fixed into a permanent image. Thereafter, the sheet 17 is transported to first discharge rollers 36 and is further transported to second discharging rollers 39 by flappers 37 and 38, by which it is discharged out of the apparatus. In this Figure, the flapper 38 is shown as closing the sheet passage, but since the flapper 38 is made of a light and is soft material, and therefore, flexible in the direction indicated by arrow D, the flapper 38 is raised by the leading edge of the sheet 17 when it passes, so that the flapper 38 does not obstruct the passage of the sheet 17.

Next, the description will be made with respect to the flow of the sheet 17 in a duplex image formation mode and in a superimposing image formation mode.

When the duplex image formation mode is selected in the image forming apparatus (images are to be formed on the opposite sides of the sheet 17), the sheet 17 is transported in the same manner as described above (simplex image formation mode) so that an image of the original is transferred and fixed on one side (the first side) of the sheet. The sheet is transported to the second discharging rollers 39 and is further advanced thereby to an unshown tray. During this transportation, the trailing edge of the sheet 17 is detected by a sheet detecting mechanism comprising a detecting lever 40 and a photosensor 41, and after a predetermined time elapses (i.e. the time period until the trailing edge of the sheet 17 passes under the flapper 38), the second discharging rollers 39 start to rotate in the reverse direction so as to reinsert it into the apparatus. The sheet 17 is transported back with the then trailing edge leading, along the flapper 38, a left side inclined surface of the flapper 37 and the guiding plate 42. Further, it is transported by way of the guiding plate 43 and 44 and is advanced to the rollers 45 with its facing orientation reversed. The sheet 17 is further advanced to lateral registration with rollers 47 through rollers 46. At this time, the lateral registration rollers 47 are at rest, so that the leading edge of the sheet 17 abuts the nip of the rollers 47, and thereafter, the rollers 45 and 46 stop. When an image forming signal for the second side is produced, the lateral registration rollers 47 start to rotate so as to supply the sheet 17 along guiding plates. Prior to the sheet 17 reaching the registration rollers 23, a lateral edge of the transfer sheet 17 is detected by a photosensor, and the lateral registration rollers 47 correct the lateral position of the sheet 17 in the direction perpendicular to the movement direction of the sheet 17, that is, perpendicular to the sheet of drawing, so as to align the lateral edge with the lateral edge position at the first image formation. The operations after the sheet 17 reaches the registration rollers 23 are similar to the simplex image forming operations as described above. After an image is formed on the second side of the sheet 17, the sheet is discharged to the outside tray by the second discharging roller 39.

When a superimposing image formation mode is selected in that image forming apparatus, the first image formation operation is the same as the image formation in the simplex mode described hereinbefore. After the image formation on the first side, the flapper 37 is placed at a position indicated by broken lines, and therefore, the sheet 17 is discharged by the first discharging rollers 36 and is transported to the guides 42 and 43 along the right side inclined surface of the flapper 37. Further, it is conveyed to the rollers 45 along the guides 43 and 44. Then, the sheet 17 reaches the lateral registration rollers 47 by rollers 46. When a predetermined period of time elapses after the trailing edge of the sheet 17 is detected by the detecting lever 40 and the photosensor 41, the flapper 37 is reset to the solid line position. When the second image formation signal is produced, the lateral registration rollers 47 start to rotate. The lateral shifting of the sheet 17 is the same as the case of the second side image formation in the duplex image forming operation. After the second image is formed on the transfer sheet 17, it is discharged to the tray outside of the machine by the second discharging roller 39. The foregoing explanation has been made as to the case where two images are superimposed, but a greater number of images may be superimposed, in which the movements of the sheet are basically the same. Here, however, the resetting of the flapper 37 from the broken line position to the solid line line position is performed only prior to the final image formation.

Now, description will be made as to the apparatus 150 for accommodating plural developing devices according to an embodiment of the present invention. The developing device accommodating apparatus 150 is optionally attached to an outside of the image forming apparatus 100, in this embodiment.

The accommodating apparatus 150 can be optionally be attached to an outside of the image forming apparatus 100 when a chromatic color image formation is desired using a chromatic color developing device other than a black developing device which is fixed in the apparatus 100 in this embodiment. Then, a desired color developing device is conveyed and supplied to the neighborhood of the photosensitive drum 11 in the image forming apparatus 100.

The accommodating apparatus 150 includes as a main body an accommodating case 151 provided with partition bottom walls or stages 151*a*, 151*b*, 151*c* and 151*d* which are formed integral with the case 151. On the partition stages 151*a*, 151*b*, 151*c* and 151*d*, chromatic color developing devices containing different color toners, for example, a red developing device 13A containing a red developer, a blue developing device 13B containing a blue developer, a green developing device 13C containing a green developer and a brown developing device 13D containing a brown developer are placed and are movable away from the stages toward the image forming apparatus 100. In the example of state shown in FIG. 1, the green developing device 13C is not contained in the accommodating case 151, but is in the apparatus 100 adjacent to the photosensitive drum 11, which is ready for developing the latent image. The transportation or transfer of the chromatic color developing device (green developing device 13C) is performed by a developer driving means X (means causing movement in the direction of arrows E and E' in FIG. 2. The developing device is transported into the apparatus 100 through an openable shutter (inlet) provided in the image forming apparatus 100. The shutter 55 is rotatable about a shutter shaft 54 in the directions F and F', and when the color developer is transported into the apparatus 100, the shutter is retracted to the broken line position by an unshown solenoid or the like so as not to obstruct the transportation of the developing device.

Figure 2:
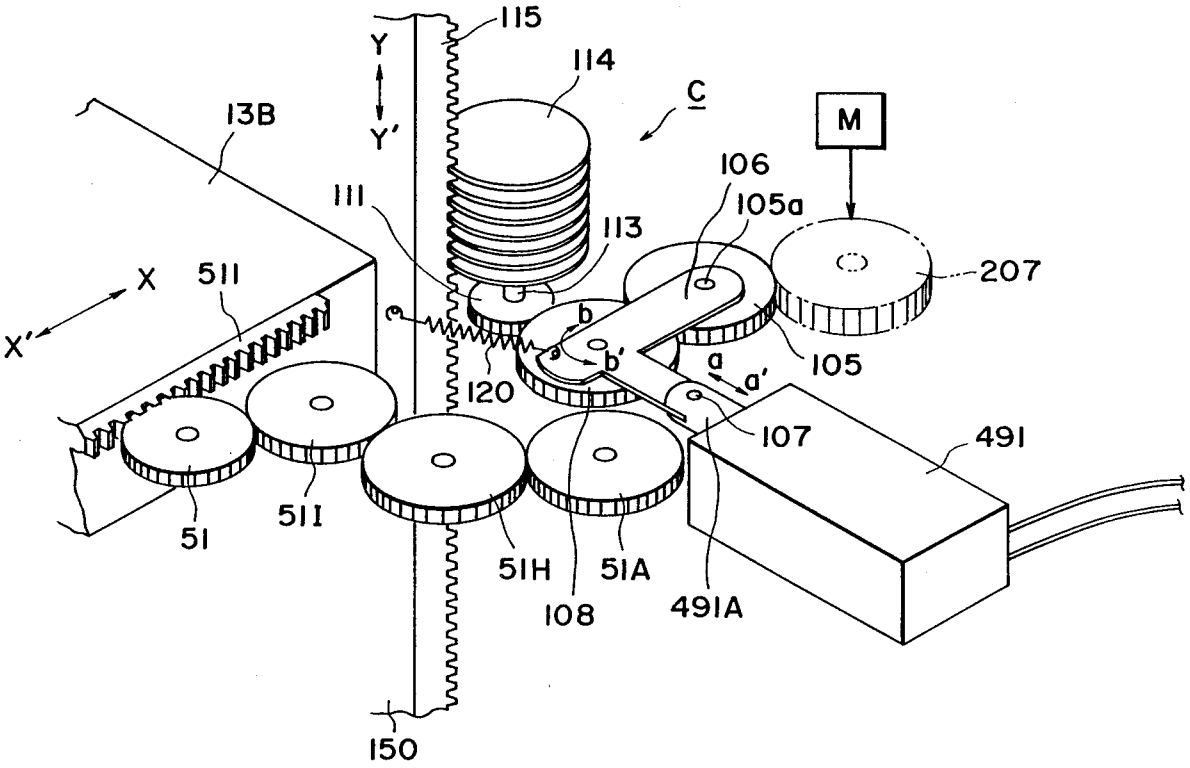
FIG. 2 is a partial perspective view illustrating a vertical driving device for the accommodating means and a horizontal driving means for the developing devices.

The accommodating apparatus 150 is further provided with means for moving the case (FIG. 2 which will be described hereinafter). By the case moving means or belt moving mechanism, the accommodating case 151 as a whole is movable up and down relative to the apparatus 100. Therefore, one of the partition stages 151*a*–151*d* which accommodates the developing device containing the desired color is moved by the case moving means into alignment with the inlet of the image forming apparatus 100 constituted by the above described shutter 55 (in the example of the Figure, the partition stage 151*c* is in alignment). Thus, a desired developing device can be transported into the apparatus 100. This is a developing device supplying position and simultaneously a developing device receiving position seen from the main assembly. For example, when the image forming apparatus selects the red developing device 13A, for example, the green developing device 13C then placed in the apparatus 100 is first transported back onto the partition stage 151*c* of the accommodating case 151 by the developing device driving means C shown in FIG. 2. During this back transportation, the shutter 55 is retracted to the broken line position i.e., the open position. When the green developing device 13C is accommodated back into the accommodating case 151, a discriminating means (unshown) confirms the presence of the green developing device 13C in the case 151. When it is confirmed, the case moving means starts to shift the entire case 151 vertically relative to the apparatus 100 (in this case, downwardly) by the case moving means, and stops when the partition stage 151*a* supporting the desired red developing device 13A is brought into alignment with the inlet (shutter 55) of the apparatus 100. Then, the red developing device 13A is transported to the neighborhood of the photosensitive drum 11 by the developing device driving means C shown in FIG. 2, and therefore, it is placed readily for developing the latent image. The operation is the same when another color developing device in the accommodating case 151 is selected.

Referring to FIG. 2, the description will be made as to driving means C for vertically driving the accommodating case 150 as a whole (in the direction indicated by Y-Y') and also for transporting a selected developing device 13B, for example toward the image forming station in a direction indicated by X-X'.

The driving means C includes a solenoid 491 which has a rod 491A movable in directions indicated by arrows a-a'. To a free end of the rod 491A, a swingable lever 106 having an "L" shape is rotatably mounted on a pin 107. An end of the swingable lever 106 is journaled to a shaft 105*a* of the gear 105, and adjacent the other end of the lever 106, a gear 108 is mounted for rotation in a horizontal plane, the gear 108 being normally meshed with the gear 105. The gear 105 is meshed with the gear 207 receiving driving force from the driving gear.

Adjacent the gear 108, there are gears 111 and 51A which are rotatable in a horizontal plane and which are to be selectively meshed with the gear 108. A worm gear 114 is fixed to a rotational shaft supporting the gear 111 as shown in the Figure. The worm gear 114 is meshed with a rack 115 extending in a substantially vertical direction on an end of the developing device accommodating case 150 near the main body. The gear 51A is meshed with a gear 51 for moving the developing device in the X-X' direction through the gears 51H and 51I which are rotatable in a horizontal plane. The gear 51 is meshed with a rack 511 formed on and projected from a side of the developing device 13B.

The swingable lever 106 is swingable about a shaft 105*a* of the gear 105 in the direction of b-b'. The swingable lever 106 is normally urged by a return spring 120 in the direction b, and when the solenoid is not energized, the gear 108 mounted thereto is meshed with the gear 111, as shown in FIG. 2.

Figure 5:
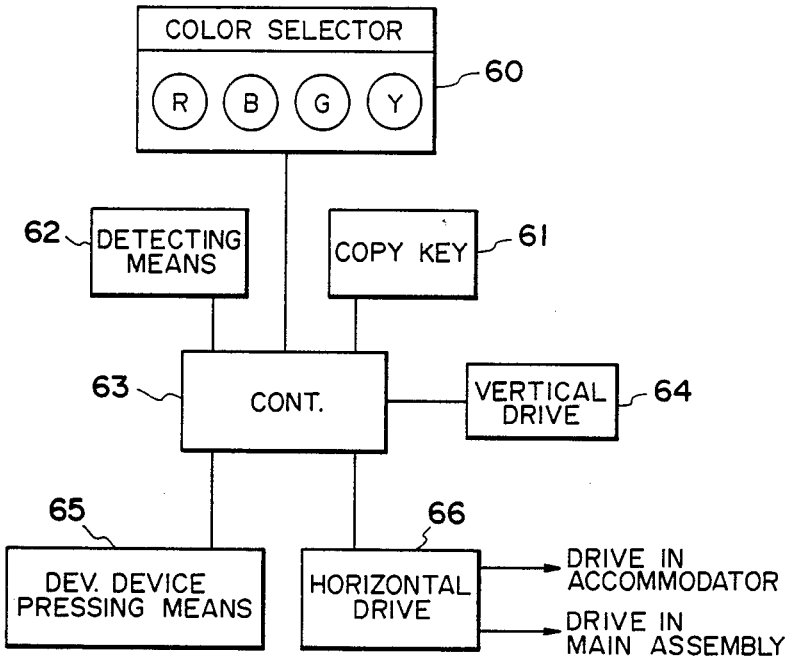
FIG. 5 is a block diagram of the control of the apparatus shown in FIG. 1.

Then the motor M is rotated in the forward direction by the control means 63 of FIG. 5 with the gear 108 shown in FIG. 2 meshed with the gear 111, the rotation of the motor is transmitted to the worm 114 through the gears 105, 108 and 111 and the shaft 113 to rotatingly drive the worm 114, by which the accommodating case 150 provided with the rack 115 meshed with the worm 114 is moved in Y direction, for example, upwardly. If the motor is reversely rotated, the accommodating case 150 moves in the Y' direction, that is, downwardly. In this manner, the accommodating case 150 is moved up and down, and therefore, one developing device having a desired color developer selected from the developing devices in the accommodating case 150 is brought to be opposed to an unshown developing device inlet of the image forming apparatus by stopping the motor M at this position. Thereafter, the control means 63 of FIG. 5 drives the solenoid 491 to retract the rod 491A in the direction a'. Then, the swingable lever 106 swings about the shaft 105*a* in the direction B' together with the gear 108 against the spring force of the return spring 120, and the gear 108 is switched to be meshed with gear 51A from with the gear 111. When the motor M is rotated forwardly with this state, the rotation is transmitted to the X-driving gear 51 through the gears 207, 105, 108, 51A, 51H and 51I, so that the X-driving gear 51 is driven, by which the developing device provided with the rack 511 meshed with the X-driving gear 51 is transported in the direction X into the image forming station of the main body of the image forming apparatus. If, on the other hand, the motor M is rotated reversely, the developing device accommodated in the apparatus 100 is transported back in the direction X' into the developing device accommodating case 150.

According to this embodiment, the developing device is not conveyed vertically and horizontally simultaneously. Thus developing device conveyance can be stabilized.

Figure 3:
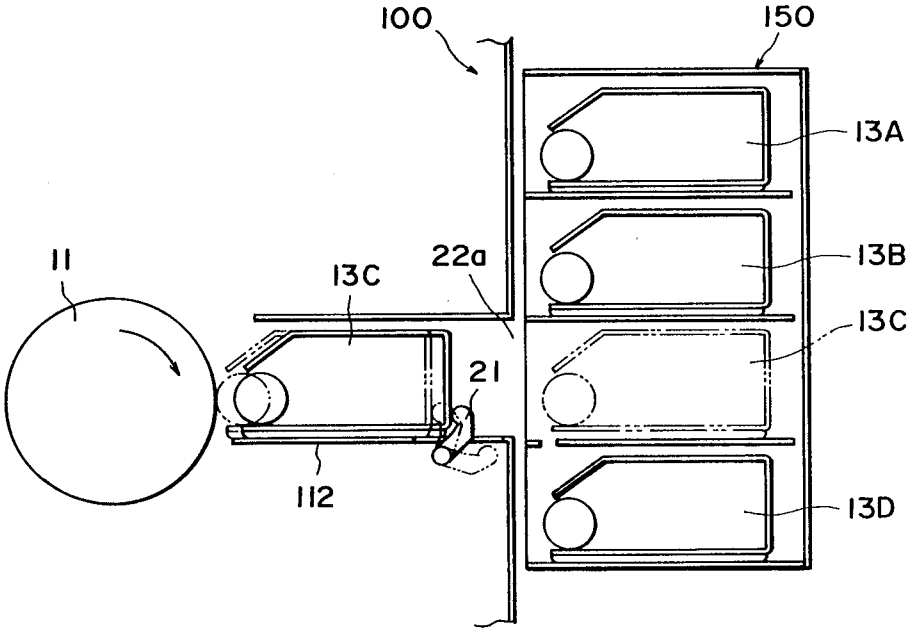
FIG. 3 illustrates urging means for moving and urging a developing device.

As shown in FIG. 3, the accommodating apparatus 150 is provided with a developing device inlet 22*a* associated with a conveying passage 112 formed substantially horizontally and extending to the photosensitive drum 11 in the main part 100 of the apparatus. The locking means includes an L-shaped lever 21 rotatably mounted on a fixed pin, resilient means (not shown) for maintaining the lever 21 at a position indicated by solid lines in FIG. 3 to lock the developing device, for example 13C, accommodated in the developing device accommodating apparatus at the position indicated by chain lines, and a solenoid (not shown for pivotting in response to a predetermined signal the lever 68 about the fixed pin in the direction b to release the locking of the developing device 13C.

Figure 4:
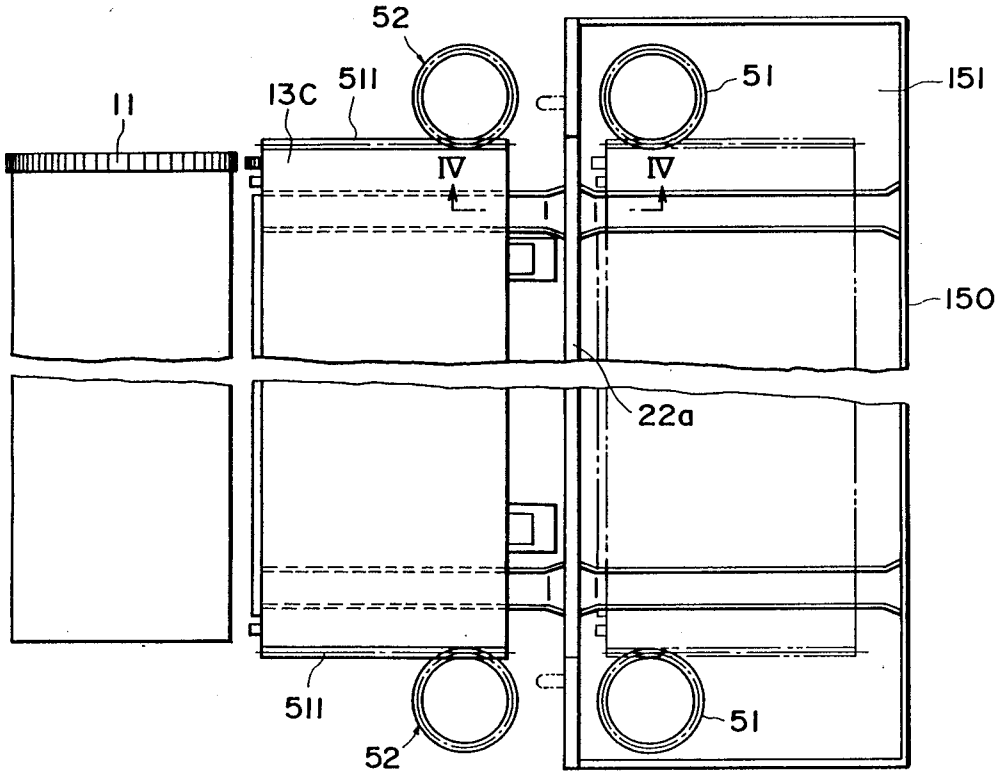
FIG. 4 is a top plan view of the horizontal driving means for the developing device.

As shown in FIGS. 3 and 4, the developing device 13C is stopped at the developing device inlet 22*a*. Then, if after the locking of the developing device 13C by the lever 21 is released by actuating the solenoid, DC motor M (FIG. 3) is driven to rotate the gear 51 (FIG. 4) in the direction indicated by arrows in FIG. 1, the developing device 13C provided with the rack 511 meshing with the gear 51 is advanced toward the photosensitive drum, and the rack 511 of the developing device 13C is brought into meshing engagement with the gear 52 of the main part of the image forming apparatus. Thus, the developing device 13C is discharged from the developing device accommodating apparatus 150, and is conveyed to a stand-by position adjacent to the photosensitive drum 11 in the main part. When this is detected by the sensor S1 as shown in FIG. 1, the DC motor M for driving the gear 52 is stopped. At this time, the pressing or urging arm 21 is at the position indicated by broken lines in FIG. 3, and when the developing device 13C comes to the solid line position, the arm 21 is rotated as shown by chain lines to push the rear part of the developing device 13C to press-contact the developing sleeve to the surface of the photosensitive drum 11 under a predetermined pressure (chain line developing position). Then, the developing device 13C is operative to develop an electrostatic latent image formed on the photosensitive drum 11 rotating in the direction indicated by the arrow.

In the apparatus of the type described above, the image forming operation in the image forming operation starts by actuating an image formation starting key, and therefore, the selected developing device transportation from the accommodating apparatus 150 to a predetermined position in the main assembly starts only in response to the signal produced by the actuation of the image formation starts signal. For this reason, a substantial time period is required from the actuation of the image formation start key to the actual start of the image forming operation. This reduces the copy speed, particularly the copy speed for the first copy, in the case where the image forming apparatus is a copy apparatus.

The operation for supplying the selected developing device to the main assembly from the accommodating apparatus 150 includes transporting the developing device contained in the main assembly previously used back to the accommodating apparatus 150, vertically moving the accommodating apparatus 150 to place the selected developing device to the supply opening through which it is introduced into the main assembly, transporting the selected developing device to the retracted position in the main assembly, and further urging the developing device to the operative position.

According to the embodiment of the present invention relating to an image forming apparatus which can be equipped with the accommodating apparatus 150, the time required from the actuation of the image formation start key to the start of the image forming operation can be reduced to increase the total copy speed.

The feature of this embodiment is in that as soon as a developing device selection key is actuated, that is, the color of the image formation is selected, the selected developing device is placed in a stand-by state, that is, in a position prepared for supplying it into the main assembly of the image forming apparatus without waiting for the actuation of the image formation start key.

The structure of the apparatus according to the present embodiment is the same as disclosed in U.S. Ser. No. 116,957 filed Nov. 5, 1987 which is assigned to the assignee of the present invention, except for the sequential operation means which will be described.

Referring to FIG. 5, there is shown a block diagram for the control of the operation which is the feature of the present embodiment.

Reference numeral 60 designates a selector for selecting a color of the developing operation, that is, for selecting a developing device containing the developer of the color. In this embodiment the selector includes four keys for red, blue, green and yellow, respectively. The image formation process starts in response to actuation of a copy key 61, the image formation process including charging, image exposure or the like as is well-known.

A developing device detecting means 62 includes sensors S1 and S2 for detecting the position of the developing device and a sensor for detecting the presence or absence of the developing device containing a desired color developer. A vertical movement mechanism 64 includes a worm gear or the like to vertically move the developing devices in the accommodating apparatus 150. An urging means 65 is movable into and out of the developing device moving passage to selectively urging the developing device to the photosensitive drum and includes cam 21 or the like to achieve this end. A mean 66 is effective to move the developing device in a horizontal plane within the main assembly and to move the developing device in a horizontal plane within the accommodating apparatus 150 for delivering it into or retracting it from the main assembly.

The control means 63 is responsive to the selector 60, copy key 61 and detecting means 62 to control the operation of means 64, 65 and 66.

Figure 6:
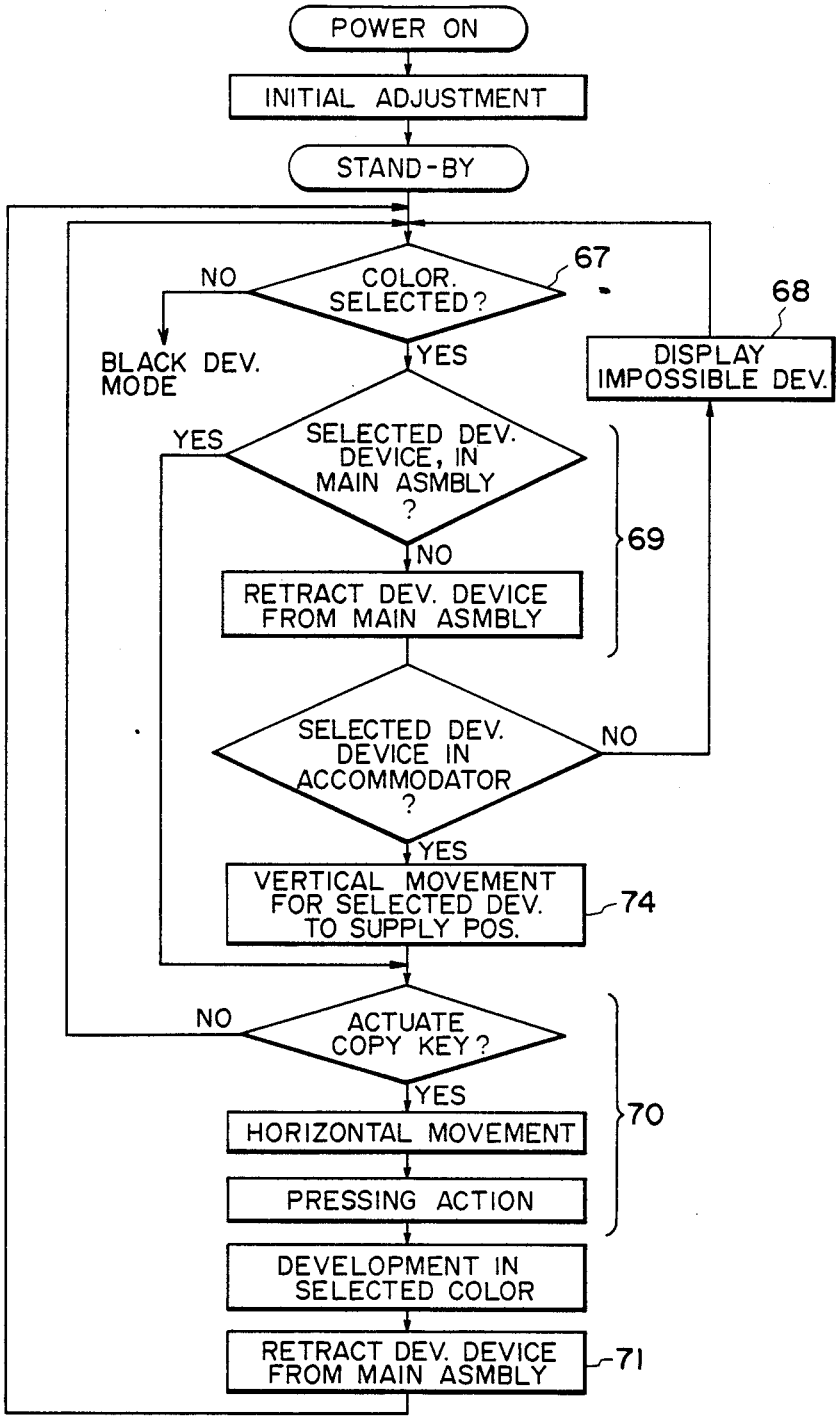
FIG. 6 is a flow chart illustrating the operational control of the apparatus according to the embodiment.
Figure 7:
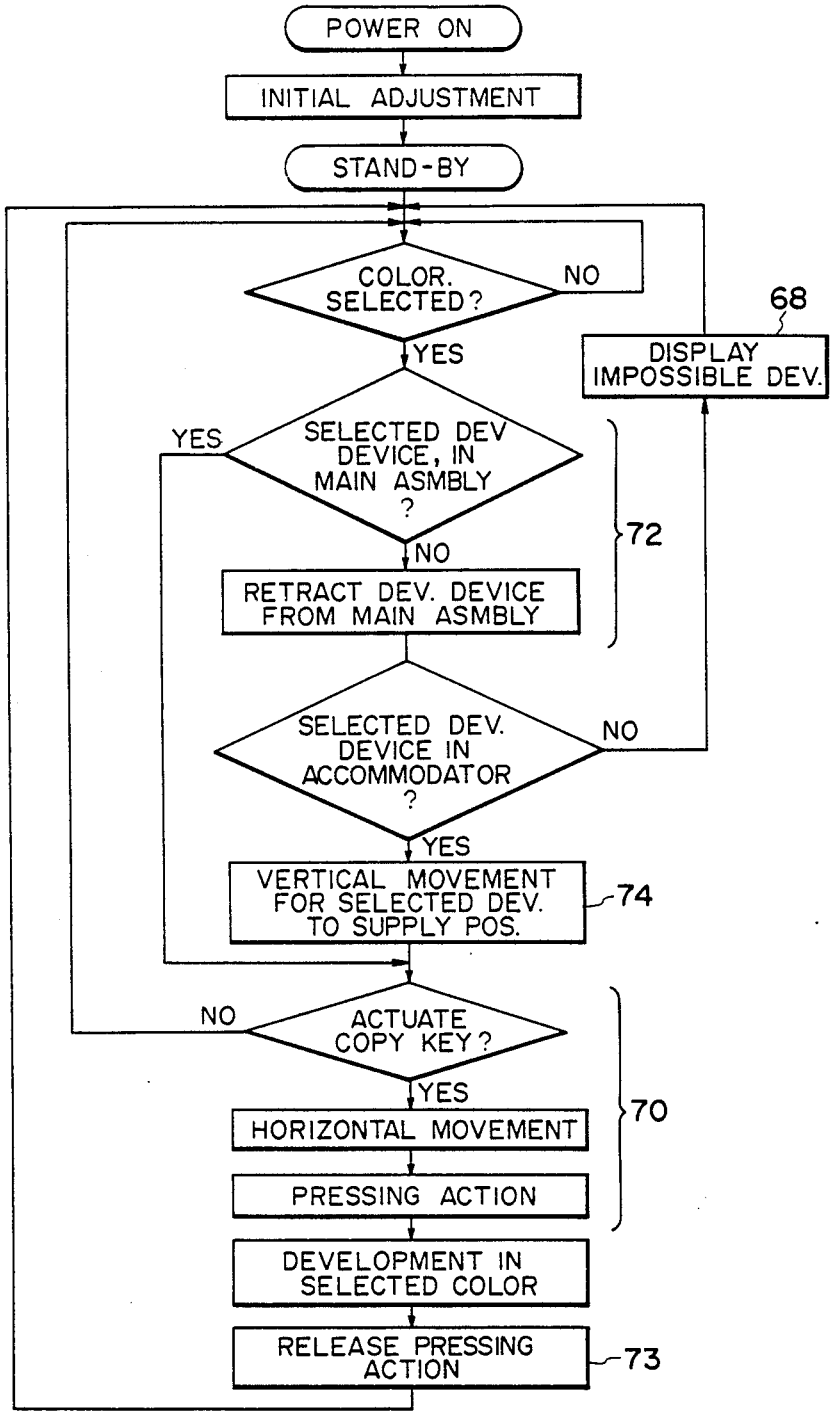
FIG. 7 is a flow chart illustrating the operational control of the apparatus according to another embodiment of the present invention.

Referring to FIGS. 6 and 7, there is shown a flow chart illustrating the sequential operation described above.

Assuming for the purpose of description that a green developing device 13C is selected by the selector in the main assembly, at step 67, the accommodating apparatus 150 operates so as to place the green developing device 13C under the stand-by state in which it can be dispensed into the main assembly 100, as shown in FIG. 1 (in the case where the black developing device is selected, this step is omitted since the black developing device 14 is stationarily mounted in the main apparatus and this is used).

More particularly, when a green key is actuated on the selector 60, the developing device for other than the green color which has been previously used and which is still present within the main assembly is transferred back into a vacant stage of the accommodating case 151 by the transportation means including the gear 52 in the main assembly and the transportation means 51 in the accommodating apparatus 150, and then, the case 151 is moved vertically by the case moving means including the gear 114 to align the partition stage 151C supporting the selected green developing device 13C with the supply inlet opening **22*a*. When the partition stage is aligned with the opening 22*a*, the vertical movement of the accommodating case 151 terminates, at step 74**.

The green developing device 13C placed in the stand-by state, that is, the state prepared for transportation into the 100, is transported into the main assembly 100 to the retracted position, that is, inoperative position (the position in which the developing device can be acted on by the urging means) by the transportation means including the gear 51 and the transportation mean including the gear 52, and then, it is set to the operative position by the urging mean 21, at step 70. Before the copy key is depressed, the number of the copies required, magnification of the copy are set, and the original to be copied is set.

The substantial image forming operation (detail thereof is omitted for the sake of simplicity, since it is of a known type) is sequentially performed after the selected developing device is set in the developing position in the manner described above.

As described above, when a developing device is selected by the selector, for example, green developing device 13C, the accommodating apparatus 150 immediately starts operation to place the selected developing device to a position prepared for transportation into the main assembly 100 from the accommodating apparatus 150. Therefore, the selected developing device supplying operation after actuation of the image formation start key includes only the horizontal transportation from the accommodating apparatus 150 to the retracted position and the urging action from the retracted position to the operative position. Thus, the time required from the actuation of the image formation start key to the start of the substantial image forming operation can be greatly reduced. The total image forming speed, particularly, the first copy speed.

FIG. 6 shows the sequence described above, wherein if there is no developing device selected by the selector, impossibility of operation is displayed, at 68. In this sequence, after completion of the developing operation with the selected developing device, the developing device is horizontally moved backwardly by the gears 51 and 52 rotating in the direction opposite to the the previous direction to collect it into the accommodating apparatus 150, at step 71. This step increases efficiency when the selected developing device is different from the previously selected one. If this step is incorporated, the collecting step 69 may be omitted. Also, if the step 71 is employed, it is convenient when the operator changes the selection of the developing device many times before the image formation start, since such change can be quickly performed, and the operation is simple. This is because the operation for placing the selected developing device to the stand-by position includes only the vertical movement of the accommodating case 151.

In the embodiment described above, when a developing device is selected, the accommodating apparatus 150 is operated to place the selected developing device in the stand-by state only by the vertical movement thereof.

In the second embodiment, the selected developing device is stepped further into the main assembly 100 by the transportation means 51 and 52, and is positioned at the retracted position which is the stand-by position in this embodiment. This is shown in FIG. 7.

This embodiment includes the step of releasing the selected developing device from the urged position to place it to the retracted position at step 73 when the developing operation using the developing device is completed. In this structure, what is required after the image formation start key is depressed is only to urge it to the operative position, the operation speed can be increased in the case where the same developing device is mainly used continuously.

The example shown in FIG. 7 is effective, when the main assembly 100 has plural developing positions which are provided with respective horizontal passages 104. However, if it has only one passage for the developing devices the time required for the image formation is reduced without the step 72. In this sense, the sequence of FIG. 7 without the step 72 is preferable.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a main assembly including an image bearing member and means for forming a latent image on said image bearing member;

accommodating means for accommodating a plurality of developing means;

said main assembly further including first moving means for moving said developing means;

said accommodating means including second moving means for moving said developing means to a position at which said developing means can be supplied into said main assembly and third moving means for moving said developing means from said supplying position into said main assembly;

means for selecting one of said developing means for developing a latent image formed by said image forming means;

means for starting an image forming operation by said image forming means; and control means for controlling said second and third moving means, said control means operating said second moving means in response to a signal from said selecting means to place the developing means selected by said selecting means to said supplying position and operating said third moving means in response to a signal from said image forming starting means to move the selected developing means into the main assembly.

2. An apparatus according to claim 1, wherein said control means further operates said first moving means in response to the signal from said image formation starting means to place the selected developing means at a near developing position in said main assembly adjacent said image bearing member.

3. An apparatus according to claim 2, wherein said first moving means including means for urging the selected developing means to an operative position from the near developing position.

4. An apparatus according to claim 3, wherein said control means releases an urging action by said urging means to allow said selected developing means to return to the near developing position after completion of the developing operation by the selected developing means.

5. An apparatus according to claim 2, wherein said control means controls said first and third moving means to collect the selected developing means back to said accommodating means, after completion of the developing operation by the selected developing means.

6. An apparatus according to claim 1, wherein said accommodating means includes a plurality of partition stages for accommodating said developing means along a vertical line and said second moving means move the plurality of said developing means vertically.

7. An image forming apparatus, comprising:

a main assembly including an image bearing member and means for forming a latent image on said image bearing member;

accommodating means for accommodating a plurality of developing means along a vertical line;

said main assembly further including first moving means for moving said developing means;

said accommodating means including second moving means for vertically moving said developing means to a position at which said developing means can be supplied into said main assembly and third moving means for moving means for moving said developing means from said supplying position into said main assembly;

means for selecting one of said developing means for developing a latent image formed by said image forming means;

means for starting an image forming operation by said image forming means; and control means for controlling said second moving means, said control means operating, without actuation of said starting means, said second moving means in response to a signal from said selecting means to place the developing means selected by said selection means to said supplying position.

8. An image forming apparatus, comprising:

a main assembly including an image bearing member and means for forming a latent image on said image bearing member;

accommodating means for accommodating a plurality of developing means;

said main assembly including first moving means for moving said developing means between a near developing position and a developing means receiving position and an urging means for urging said developing means to a developing position at which a developing operation may be performed;

said accommodating means including second moving means for moving said developing means to a position at which said developing means can be supplied into said main assembly and which is opposed to said receiving position and third moving means for moving said developing means from said supplying position into said main assembly;

means for selecting one of said developing means for developing a latent image formed by said image forming means;

means for starting an image forming operation by said image forming means; and control means for controlling said first, second and third moving means, said control means operating said first, second and third moving means in response to a signal from said selecting means to place the developing means selected by said selecting means to said supplying position and further into said main assembly through said receiving position and operating said urging mean in response to a signal from said image formation starting means to move the selected developing means to said developing position.

9. An image apparatus, comprising:

a main assembly for forming an image;

accommodating means for accommodating a plurality of developing means, which are selectively supplied into said main assembly;

means for selecting one of said developing means to be supplied into said main assembly;

means for starting an image forming operation by said main assembly; and means for placing, in response to a signal from said selecting means, and without actuation of said starting means, the selected one of said developing means in a standby position from which it can be directly supplied into said main assembly.

* * * * *